US005609767A

United States Patent [19]

Eisenmann

[11] Patent Number: 5,609,767

[45] Date of Patent: Mar. 11, 1997

[54] METHOD FOR REGENERATION OF ELECTROLESS NICKEL PLATING SOLUTION

[76] Inventor: Erhard T. Eisenmann, 5423 Vista Sandia, NE., Albuquerque, N.M. 87111

[21] Appl. No.: 241,234

[22] Filed: May 11, 1994

[51] Int. Cl.[6] ..... B01D 15/04

[52] U.S. Cl. ..... 210/665; 106/1.22; 106/1.27; 210/667; 210/670; 210/688

[58] Field of Search ..... 106/1.27, 1.22; 210/665, 667, 670, 688, 726, 912

[56] References Cited

U.S. PATENT DOCUMENTS

| | | | |
|---|---|---|---|
| 4,303,704 | 12/1981 | Courduvelis et al. | 210/688 |
| 5,112,392 | 5/1992 | Anderson et al. | 210/688 |
| 5,258,061 | 11/1993 | Martyak et al. | 106/1.27 |

*Primary Examiner*—Ivars Cintins
*Attorney, Agent, or Firm*—Timothy D. Stanley

[57] ABSTRACT

An electroless nickel(EN)/hypophosphite plating bath is provided employing acetic acid/acetate as a buffer and which is, as a result, capable of perpetual regeneration while avoiding the production of hazardous waste. A regeneration process is provided to process the spent EN plating bath solution. A concentrated starter and replenishment solution is provided for ease of operation of the plating bath. The regeneration process employs a chelating ion exchange system to remove nickel cations from spent EN plating solution. Phosphites are then removed from the solution by precipitation. The nickel cations are removed from the ion exchange system by elution with hypophosphorous acid and the nickel concentration of the eluate adjusted by addition of nickel salt. The treated solution and adjusted eluate are combined, stabilizer added, and the volume of resulting solution reduced by evaporation to form the bath starter and replenishing solution.

9 Claims, 1 Drawing Sheet

Flow Chart for Regenerable Electroless Nickel Plating System

METHOD FOR REGENERATION OF ELECTROLESS NICKEL PLATING SOLUTION

The United States Government has rights in this invention pursuant to Contract No. DE-AC04-76DP00789 between the Department of Energy and American Telephone and Telegraph Company.

BACKGROUND OF THE INVENTION

1. Field of the Invention

The present invention relates to electroless nickel plating solutions and a method for their regeneration. More particularly, the present invention relates to electroless nickel plating solutions and regeneration methods for indefinite use of the solutions without discharge of hazardous waste.

2. Description of the Prior Art

Electroless nickel (EN) plating is known and is useful for generating corrosion and wear resistant coatings on metal or plastic parts, both on open surfaces or inside cavities. Common applications are for electronics, computers, valves, aircraft parts, copier and typewriter parts and printing press rolls.

In most electroless nickel plating baths the nickel ions are catalytically reduced by sodium hypophosphite, which is oxidized to phosphite in the redox reaction. Due to side reactions, three moles of hypophosphite are required to reduce one mole of nickel. The reactions proceed in the presence of a catalyst as follows:

$$Ni^{2+} + H_2PO_{2-} + H_2O \xrightarrow{\text{cat.}} Ni + H_2PO_3 + 2H^+ \quad (1)$$

$$H_2PO_{2-} + H_2O \xrightarrow{\text{cat.}} H_2PO_{3-} + 2H \quad (2)$$

$$H_2PO_{2-} + H \longrightarrow P + OH^- + H_2O \quad (3)$$

Thus, for each gram of plated nickel-phosphorus alloy about 5 g of sodium orthophosphite is generated in the plating bath. If air is used to agitate the bath, an additional 5 to 10 per cent of the hypophosphite is oxidized.

During the plating process the nickel and hypophosphite are continuously depleted and must be replenished in order to maintain the chemical balance of the bath. Plating quality and efficiency decrease as the phosphite level increases in the solution and it becomes necessary to discard the plating bath, typically after about 25 grams of nickel gave been plated per liter of EN bath. Treatment of the spent solution is desirable, both to improve the economics of the process and to avoid nickel-containing hazardous waste disposal.

It has been proposed to remove phosphites from the spent EN plating bath either through precipitation techniques or treatment in a weak-base anionic ion exchange resin column to remove undesired phosphites, making the bath usable for further plating operations. (See Konrad Parker, Plating and Surface Finishing, vol. 67, p. 48(March, 1980)) Another ion exchange process has been proposed using strong-base ion-exchange resin in the hypophosphite form (pretreated with sodium hypophosphite) to exchange anions including phosphite with bound hypophosphite. (See F. Levy et al., *Plating and Surface Finishing,* vol. 74, p. 60(September 1987))

A relatively complex procedure combining ion exchange and precipitation has been proposed which reaches the desirable goal where all chemicals entering the plating bath are removed after their purpose has been served. (See R. W. Anderson et al, *Plating and Surface Finishing,* vol. 77, p. 18(March 1992) and U.S. Pat. No. 5,112,392 (May, 1992)).

The present invention overcomes the deficiencies in the above processes by providing a simplified procedure for treating spent plating bath solution which allows its perpetual use and avoids all hazardous waste discharge. This is accomplished by providing a novel EN plating bath composition compatible with the regeneration process. The novel EN plating bath of the present invention is comparable with existing commercial baths in terms of quality and ease of production, but is also suitable for a regeneration process which enables its perpetual use while avoiding hazardous waste disposal. A novel concentrated starter and replenishment solution is provided for ease in forming and operating the EN bath of the present invention.

Existing commercial EN baths typically reach end-of-life after the original nickel content has been replaced four times through replenishment. Since normal operation acidifies the bath, neutralization with ammonium hydroxide is common practice. This leads to buildup of neutral salts and causes a decline in the plating performance and, eventually, necessitates disposal of the bath. Commercial baths are not suitable for the inventive regeneration scheme because (1) the presence of ammonium salts interferes with the precipitation of calcium compounds, precluding consistent, high-quality nickel plates, and (2) conventional EN baths depend on frequent or continuous replenishment for stable performance, which are incompatible with the regeneration scheme. For optimal performance in a plating and regeneration cycle, an EN bath must show minimal drift in performance over extended usage. This can be accomplished by stabilizing the solution pH. Commercial EN baths may contain lactic acid or other organic acids with a low buffer capacity for the usual operating pH of 5. These acids are also undesirable if calcium compounds can be formed that precipitate during the regeneration process and lead to an undesirable change in bath composition. In contrast, the novel bath composition of the present invention contains acetic acid/acetate as a buffer, which has a ten times higher buffer capacity than lactic acid in the relevant pH range, and forms a highly soluble calcium salt which will not precipitate during regeneration.

The fundamental shortcoming of the -392 process is that it is too complicated, involves too many processing steps, and is not completely effective. The chemical principles that govern the functions of electroless nickel plating are as follows: (1) Electroless nickel baths operate either in acidic or in alkaline medium. Only the acidic type is conducive to rejuvenation with the methods considered by the -392 patent. These baths contain hypophosphite and nickel ions as primary ingredients. (2) Control of the pH is crucial for constant quality of the deposit and extended life of the bath. During use, the bath pH drifts to lower values, which causes an increase in the rate of phosphorus codeposition. When pH corrections are made by adding sodium hydroxide, there is a chance that nickel will precipitate, which, in turn, may initiate spontaneous plating and result in the destruction of the bath. This possibility can be minimized by adding ammonium hydroxide, instead of sodium hydroxide, except that the bath becomes unsuitable for regeneration as a result. Another path for circumventing the decomposition during pH adjustments is to include a complexing agent into the bath make-up, but again, the bath becomes less suitable for the regeneration procedure of either the -392 patent or the instant invention. The preferred method for maintaining the pH within reasonable bounds is to include a pH buffer in the bath. The -392 patent chose lactic acid/lactate as buffer system. Unfortunately, this buffer is best suited for a pH of 3.1, and is completely ineffective for the desired level of 5. The process of the -392 patent risks losing the bath through precipitation and spontaneous plating along with the inconvenience of making additions of sodium hydroxide.

The instant invention employs acetic acid/acetate buffer, which is inexpensive, yet excellent for the desired pH. Its buffer maximum is at pH 4.8. Other buffers for this pH regime exist, such as propionic, butanoic, pentanoic acid and others but, for an electroless nickel bath these alternatives must have no tendency to form a complex or an insoluble compound with nickel ions. This, along with cost, severely limits the choice of alternative buffers. Nickel lactate, incidentally, is sparingly soluble and precipitates at pH 5.5 to 6. Employing a buffer that accurately matches the desired pH range has the advantage of sodium hydroxide additions being superfluous. The present invention exploits this feature by avoiding additions of sodium hydroxide additions in the first instance, and therefore avoids the need for removing sodium ions during the recovery process.

The operation of the EN plating system of the -392 patent requires the removal of sodium ions along with sulfate and phosphite ions. Only phosphite needs to be removed in the process of the present invention. When attempting to remove phosphite from the nickel solution by precipitation, one faces the problem of losing some or most of the nickel by coprecipitation. Researchers have tried to design selective precipitation conditions, in which nickel does not participate (See Parker, above), however, the precipitant consistently spoils the quality of subsequent nickel plates. The desirable approach is to first remove the nickel from the solution, followed by precipitating the phosphite, and finally, recombining nickel with the filtered solution, the method accomplished in the present invention by removal of nickel, only, by reaction with a chelating ion exchange resin. The effluent from this process is nickel-free, hence nonhazardous and suitable for disposal in many publicly owned water treatment works. This effluent, however, is also suitable for selective removal of phosphite ions by precipitation with calcium hydroxide. If carried out with reasonable care, the pH will rise to about 13, no calcium will be passed into the filtrate, and the performance of the reconstituted nickel bath will not be degraded by the presence of calcium ions. The nickel ions are removed from the ion exchange resin by elution with hypophosphorous acid, the resulting eluate adjusted for nickel content and combined with the above filtrate, and the combined solution adjusted by evaporation to form the concentrated starter and replenishment solution of the present invention.

SUMMARY OF THE INVENTION

The present invention relates to a novel EN plating bath and a method for its regeneration to allow perpetual use of the bath while avoiding the necessity of hazardous waste disposal. The present invention is useful in the electroless nickel plating of metal or plastic parts for use, for example, in the electronics, computer, aircraft, and office machine industries.

An object of the invention is to provide a novel electroless nickel plating bath solution.

A further object of the invention is to provide an electroless nickel plating bath solution capable of regeneration for perpetual use.

A still further object of the present invention is to provide an electroless nickel plating solution capable of perpetual operation and regeneration which avoids the production of hazardous waste during its regeneration.

A still further object of the present invention is to provide a process for regeneration of an electroless nickel plating solution which avoids the production of hazardous waste.

A still further object of the present invention is to provide a novel concentrated starter and regeneration solution for use in the novel electroless plating bath of the present invention.

Additional objects, advantages, and novel features of the invention will become apparent to those skilled in the art upon examination of the following description or may be learned by practice of the invention. The objects and advantages of the invention may be realized and attained by means of the compositions and process particularly pointed out by the appended claims.

To achieve the foregoing and other objects, and in accordance with the purpose of the present invention, as embodied and broadly described herein, the present invention may comprise a regenerable aqueous electroless nickel(EN) plating bath solution comprising nickel cations, hypophosphite anions, and a buffer for maintaining a pH of about 5 in said aqueous bath. The present invention may further comprise a method for regeneration of the inventive EN plating bath.

BRIEF DESCRIPTION OF THE DRAWINGS

The accompanying drawing, which is incorporated in and forms part of the specification, illustrates an embodiment of the present invention and, together with the description, serves to explain the principles of the invention.

DETAILED DESCRIPTION OF THE INVENTION

Figure 1:
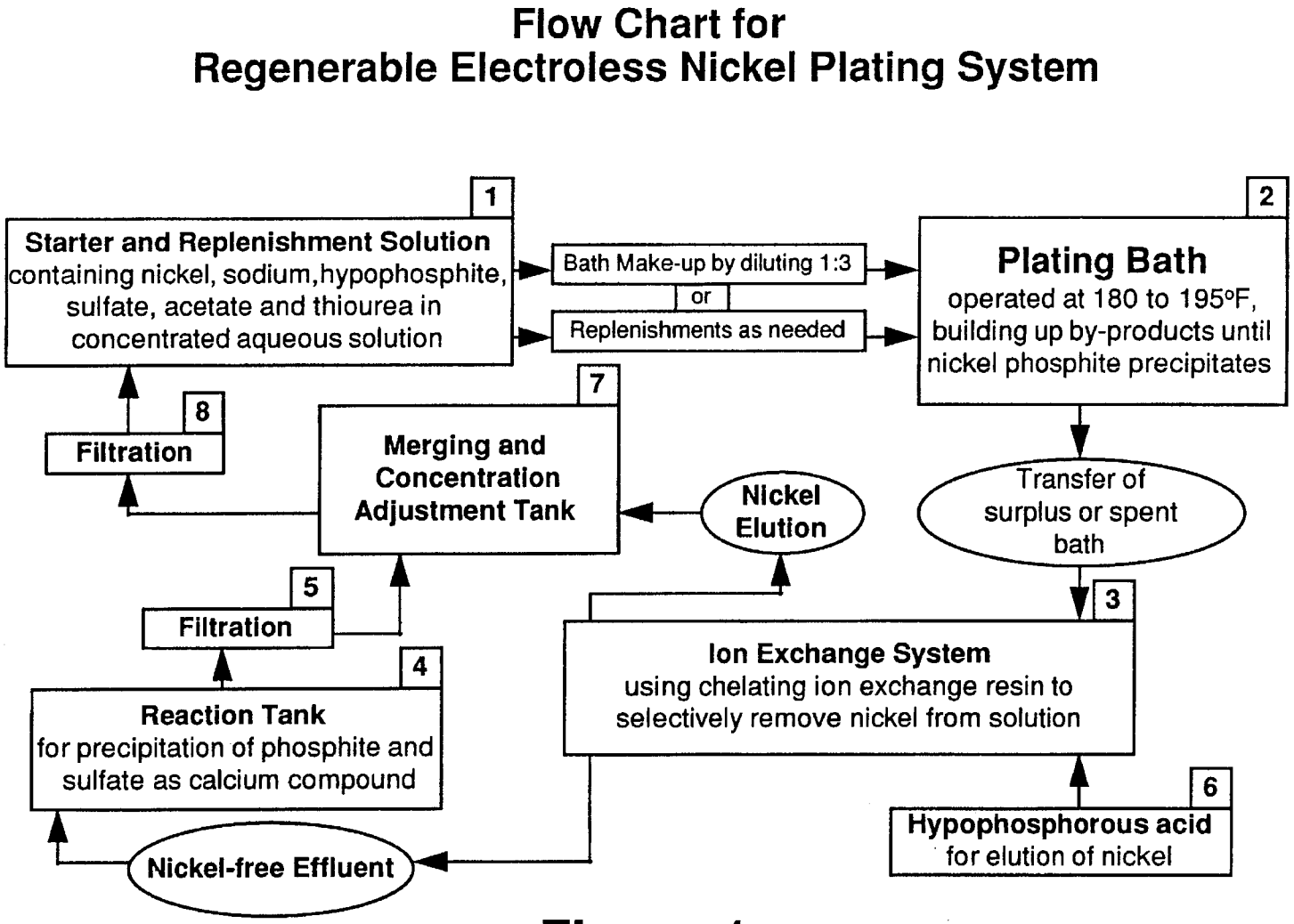
FIG. 1 is a diagrammatic illustration of the system for operation an regeneration of the EN bath according to the present invention.

In accordance with the present invention, a novel electroless nickel(EN) plating bath is prepared which is particularly amenable to regeneration by a novel spent bath regeneration process.

The regeneration-compatible EN plating bath of the present invention comprises an aqueous solution containing nickel, hypophosphite, a buffer for maintaining apH near 5, for example, acetate, and a stabilizer, for example, thiourea. The preferred composition of the solution comprises in the range of from 0.05 to 0.12 mole per liter of a nickel salt, from 0.5 to 3 mole per liter of an acetate, from 0.1 to 0.3 mole per liter of a hypophosphite, and from 3 to 5 parts per million thiourea. The preferred cations for acetate are sodium or potassium. The preferred anions for nickel are hypophosphite or sulfate. The preferred operating temperature of the plating bath is in the range of from 180° to 195° F. The preferred operating pH is within the range of from about pH 4.4 to about pH 5.5. Alternative stabilizers useful in the invention are substituted thioureas or lead ions.

In the preferred mode of operation, the chemicals are dissolved in water to form a concentrated starter and replenishing solution, with sodium acetate at 2.3 mole per liter, acetic acid at 1.0 mole per liter, nickel hypophosphite at 0.33 mole per liter, sodium hypophosphite at 0.33 mole per liter, and thiourea at 15 mg. per liter. Equimolar amounts of calcium hypophosphite(or calcium hydroxide and hypophosphorous acid) and nickel sulfate may be substituted for nickel hypophosphite. Calcium sulfate precipitates in this case, requiring removal by filtration. This solution is stable and does not tend to spontaneously plate-out nickel, even at the boiling point. For a working bath, the starter and replenishing solution is diluted with water in a range of proportions between 1:3 and 1:10. During plating, the same concentrated solution is added to maintain the plating performance of the bath. Maintaining the nickel concentration also maintains the pH and the hypophosphite content. Only one of these three bath parameters needs to be monitored to enable complete control of the bath composition. Replenishments and solution evaporation determine whether the volume of the bath increases or decreases, i.e. if solution needs to be bailed out or water must be added. Bath usage causes the concentrations of phosphite, acetate and sulfate to increase, and eventually to reach the point, where nickel phosphite begins to precipitate. This is the case when about 15 g nickel have been plated per liter bath at a nickel concentration of 0.05 mole per liter and a pH of 5. More nickel can be plated at lower pH and lower nickel concentration.

Of course, desired amounts of chemicals and water may be added directly to the bath to initiate and replenish the bath within the above-described compositional ranges. The concentrated starter and replenishment solution described above is merely an expedient to simplify preparation and maintenance of the EN bath. Analytical techniques to determine existing concentrations of materials in the bath during plating operations and during regeneration are well known in the art and do not form a part of this invention.

In further accordance with the present invention a process for regeneration of spent EN bath is provided which is compatible with the inventive bath described above. The inventive process comprises the steps of (1) passing spent EN bath through chelating ion exchange resin to remove nickel ions therefrom, (2) treating effluent with a base such as calcium hydroxide or magnesium oxide or hydroxide to precipitate phosphite ions, while allowing the pH to rise to 13 or above, (3) separating the solution from the resulting precipitate, (4) eluting nickel ions from the ion exchange resin from step (1) above with hypophosphorous acid, (5) adding equimolar amounts of nickel sulfate and calcium hydroxide to the solution obtained in step (4) to adjust the nickel concentration and to precipitate calcium sulfate, (6) filtering the mixture produced in step (5), (7) combining the solutions from steps (3) and (6), (8) adding thiourea and (9) reducing the volume of solution by evaporation to essentially reconstitute the concentrated starter and replenishing solution from which new EN bath may be prepared by dilution.

The regenerable EN plating system of the present invention is further described by reference to the diagrammatic representation in FIG. 1, wherein the regenerable EN plating system includes starter and replenishment solution reservoir. Starter and replenishment solution from reservoir 1 is diluted to make EN plating bath 2, and subsequently added periodically to EN plating bath 2 as a replenishment to maintain desired nickel concentration therein during plating operations. Surplus or spent EN bath solution is transferred from EN plating bath 2 to ion exchange system 3 when regeneration of the fluid is desired. Nickel-free effluent is transferred from ion exchange system 3 to reaction tank 4 where an appropriate amount of calcium hydroxide is slowly added with agitation resulting in the precipitation of phosphite and sulfate as calcium compounds. The effluent from reaction tank 4 is directed to filter 5 for removal of precipitates. Upon completion of treatment of spent fluid from the EN bath, hypophosphorous acid from reservoir 6 elutes ion exchange system 3, thereby removing the nickel ions. The resulting nickel eluate is transferred to merging and concentration adjustment tank 7, to be combined with the filtered solution from tank 4. Equimolar amounts of nickel sulfate and calcium hydroxide are added to adjust the nickel concentration. The mixture is then directed to filter 8 for removal of calcium sulfate precipitate and the filtrate therefrom returned to merging and concentration adjustment tank 7. Desired amounts of thiourea are added to the merged solution in tank 7, and solution volume is adjusted by evaporation. Concentrate from merging and concentration adjustment tank 7 is directed to replenishment solution reservoir 1 for reuse in the system.

The inventive regeneration procedure is carried out by first pumping slightly cooled (<140° F.) solution from the plating tank through a properly dimensioned ion exchange column containing the chelating ion exchange resin and then into a reaction tank. There is no need for washing the resin bed after the solution has passed through. A phosphite analysis determines the amount of calcium hydroxide that should be added under vigorous agitation, to convert most but not all phosphite into insoluble calcium phosphite. At this point, the pH goes to 13 or higher. Filtration of the solution concludes the phosphite removal process. Hypophosphorous acid in an amount equivalent to the phosphite in the precipitate elutes the ion exchange column. The nickel-to-hypophosphorous acid ratio in the eluate is next adjusted to 1 to 3 by adding equimolar amounts of calcium hydroxide and nickel sulfate. Calcium sulfate precipitates and requires filtration before the solution can merge with the filtered solution from the phosphite removal procedure. An addition of 15 mg thiourea is made for every mole of hypophosphorous acid added in the regeneration process. The resulting solution is reduced by evaporation until the nickel concentration is 0.33 mole per liter. The resulting solution composition is essentially equal to that of the starter and regeneration solution.

EXAMPLE

Laboratory plating studies of electroless plating solution carried out with 1 liter glass beakers on a hot plate indicated that acetic acid/acetate is a superior buffer, as compared with buffers preferred in published reports. Thiourea was introduced as a preferred stabilizer, in lieu of the more commonly used lead or cadmium ions. Thiourea was found to safely prevent spontaneous plating in the 3 to 5 parts per million range. Higher concentrations preclude plating altogether, while 3 parts per million or less led to the breakdown of the bath, particularly at the point where precipitation of nickel phosphite initiated.

In order to scale up to an intermediate-sized electroless nickel plating bath, an apparatus was constructed with a 10 liter solution capacity, featuring continuous cascading solution flow with filtration at a rate of about 3 liters per minute, and heating with a 500 watt Teflon heater panel. The relatively high flow rate is necessary to preclude local overheating, which may lead to spontaneous nickel deposition on the heater. Two 8 by 9 inch laminated copper/epoxy glass panels served as plating substrates for assessing the deposit appearance and for measuring the amount of nickel deposit by weight gain. A typical plating run required 4 hours of heating before 160° F. was reached and nickel deposition started. Within another 4 hours almost all of the 58 grams of nickel in the bath plated out and the process became inactive, unless the nickel and hypophosphite concentrations were maintained through replenishments.

Experiments were carried out to determine optimal plating conditions with respect to deposit appearance and plating rate. These criteria closely agreed with literature data and commercial disclosures for known bath compositions. Bath turnover and associated effects were then investigated. Regeneration of the spent plating solution was carried out according to the procedure previously described. The plating bath was periodically rejuvenated by adding concentrated starter and replenishing solution of the composition previously described. Operating the bath at an initial and rejuvenated concentration of 0.1 mole/liter nickel, 0.3 mole/liter hypophosphite, 1 mole/liter acetate, 5 parts per million thiourea and a starting pH of 5.2, the following observations were made:

(1) A makeup and replenishment solution may be prepared, which simplifies the compositional control of the bath. For a new bath, this solution is diluted with water. For replenishments, full strength additions are made to the bath at a rate that maintains the nickel concentration, and simultaneously controls the hypophosphite, thiourea and pH levels.

(2) Replenishments may be continued until about 150 grams of nickel have been deposited. At this stage, any further addition of nickel ions leads to the precipitation of nickel phosphite, which should be preempted by the regeneration procedure. However, if the nickel is allowed to be depleted to a lower concentration and a lower pH, the bath remains functional.

(3) Nickel deposits from a regenerated and replenished bath have the same bright appearance as those from a new bath. Precipitated nickel phosphite in the bath does not immediately lead to dull deposits.

(4) The acetate buffer permits a 70% depletion of the nickel content with the pH controlled at 4.8+0.3. If replenishments are made, the pH initially drifts from 5.2 to 4.8 and then remains constant.

(5) During the regeneration, nickel adsorption on the ion exchange resin benefits from the presence of the acetate buffer.

(6) Phosphite precipitation with calcium hydroxide requires time for completion, because the reaction is heterogeneous. The filterability improves if the reagent is added very slowly.

(7) The nickel deposition rate was measured by weight gain as 7 microns per hour at 180° F. and as 18 microns per hour at 193° F.

(8) During continuous plating, evaporation of the exposed solution surface did not completely offset the volume growth due to the replenishments. Plating only two thirds of the time caused the bath volume to contract.

Ion exchange resins useful in the practice of the present invention include Amberlite IRC-718 Resin from Rohm and Haas, Philadelphia, Pa. and AS-505 Resin from Sybron Chemicals, Inc., Birmingham, N.J. The exchange capacity of these resins is approximately 1 equivalent per liter. Therefore, the minimum amount of resin needed for the replenishment of an EN bath with 0.1 mole/l nickel is 0.11/1. An allowance must be made for inefficiency in the adsorption process.

The particular compositions and process parameters discussed above are cited merely to illustrate particular embodiments of this invention. It is contemplated that the use of the invention may involve differing compositions and process parameters as long as the principle, the employment of a novel regeneration-comparable EN bath and a novel regeneration procedure, is followed. The invention contemplates other derivative compositions and process steps such as systems for electroless plating of metals other than nickel and regeneration of the resulting spent bath. It is intended that the scope of the invention be defined by the claims appended hereto.

I claim:

1. A method for regeneration of spent EN plating solution, wherein spent EN plating solution comprises nickel ions, hypophosphite ions, an acetic acid or acetate buffer, a stabilizer, phosphite ions, sulfate ions, and water, comprising the steps of:

a) passing spent EN plating solution through a chelating ion exchange resin column to remove selectively and substantially all nickel ions from said solution for retention in said resin column;

b) treating the effluent from step (a) with a base selected from the group consisting of calcium hydroxide and magnesium oxide in an amount sufficient to precipitate substantially all phosphite ions and a major portion of sulfate ions therefrom, the precipitate being substantially free of Ni;

c) separating the resulting solution from the precipitate of step (b);

d) eluting the nickel ions from the ion exchange resin resulting from step (a) with a solution of hypophosphorous acid; and e) combining the resultant solution from steps (b) and (d) to obtain a regenerated EN plating solution.

2. The method of claim 1 wherein said spent EN solution is cooled to a temperature below 140° F. before passing through said ion exchange resin column.

3. The method of claim 1 wherein said base treatment step is carried out with gradual additions of calcium hydroxide under vigorous agitation in an amount sufficient to raise the solution pH to a value above 13.

4. The method of claim 1 wherein said hypophosphorous acid is provided in an amount equivalent to the amount of phosphite in the precipitate resulting from said base treatment step.

5. The method of claim 1 further comprising the step of adding nickel cations to the eluate from said ion exchange resin in said eluting step prior to said combining step to adjust the nickel concentration thereof to a desired level.

6. The method of claim 5 said nickel cations are provided by the addition of equimolar amounts of nickel sulfate and calcium hydroxide, and any resulting calcium sulfate precipitant is removed from the resulting solution prior to said combining step.

7. The method of claim 1 wherein said eluting step is carried out with an amount of hypophosphorous acid in an amount equivalent to the amount of phosphite precipitate removed after said base treatment step.

8. The method of claim 1 further comprising the step of adding thiourea to the regenerated EN solution in an amount equal to about 15 mg of thiourea per mole of hypophosphorous acid added in said eluting step.

9. The method of claim 1 wherein the volume of the resulting regenerated EN solution is reduced by evaporation until the nickel concentration is about 0.33 moles per liter to form a concentrated EN starter and replenishment solution.

* * * * *